United States Patent [19]

Brugger et al.

[11] 4,010,084

[45] Mar. 1, 1977

[54] METHOD OF AND ELECTROLYTIC BATH FOR THE ELECTRODEPOSITION OF SEMIBRIGHT NICKEL AND NICKEL-COBALT COATINGS UPON A METAL SURFACE

[75] Inventors: Robert Brugger, Bernhausen; Martin Köhl, Dusseldorf; Horst Krause, Neuss, all of Germany

[73] Assignee: Langbein-Pfanhauser Werke AG, Neuss, Germany

[22] Filed: Oct. 23, 1975

[21] Appl. No.: 625,095

Related U.S. Application Data

[63] Continuation of Ser. No. 475,264, May 31, 1974, abandoned.

[30] Foreign Application Priority Data

June 1, 1973 Germany ..... 2327881

[52] U.S. Cl. ..... 204/43 T; 204/49

[51] Int. Cl.[2] ..... C25D 3/12; C25D 3/16; C25D 3/18; C25D 3/56

[58] Field of Search ..... 204/49, 43 T, 43 N, 204/43 P

[56] References Cited

FOREIGN PATENTS OR APPLICATIONS

| | | | |
|---|---|---|---|
| 837,050 | 6/1960 | United Kingdom | 204/49 |
| 962,873 | 7/1964 | United Kingdom | 204/49 |
| 1,037,617 | 7/1966 | United Kingdom | 204/49 |

*Primary Examiner*—G. L. Kaplan
*Attorney, Agent, or Firm*—Karl F. Ross; Herbert Dubno

[57] ABSTRACT

Semibright (matte-gloss) coatings of nickel or nickel-cobalt are deposited on a metal substrate from a WATT'S-type sulfamiate or fluorobate electroplating bath at a pH of 2.5 to 5.8, a temperature of 15° to 70° C and a current density of 0.5 to 20 A/dm² in the presence of a substance which deposits with the metal and ensures a semibright or matte-gloss finish. The substances form in situ within the bath from a cationic or amphoteric first component and a second component consisting of an organic anion interactive with the first component to produce a flocculate.

9 Claims, No Drawings

METHOD OF AND ELECTROLYTIC BATH FOR THE ELECTRODEPOSITION OF SEMIBRIGHT NICKEL AND NICKEL-COBALT COATINGS UPON A METAL SURFACE

This is a continuation of application Ser. No. 475,264, filed May 31, 1974, now abandoned.

FIELD OF THE INVENTION

The present invention relates to the production of semibright (matte-gloss) nickel-containing coatings by electrodeposition upon metallic surfaces and, more particularly, to the production of nickel coatings and nickel-cobalt coatings from Watt's-type sulfamate or fluoroborate electroplating baths.

BACKGROUND OF THE INVENTION

For the purposes of the present disclosure, a semibright metal coating will be one which is of uniform but somewhat dull texture as can be described as "mat-gloss". A Watt's-type plating bath is one which contains nickel sulfate, nickel chloride and boric acid and, where the deposit is to consist of nickel-cobalt, a corresponding cobalt salt. Finally, the expression "nickel-containing coating" and terms of similar import are used to refer to coatings consisting of nickel or of nickel-cobalt. Reference is made to THE ENCYCLOPEDIA ELECTROCHEMISTRY, Reinhold Publishing Co., New York, 1964, page 845, inter alia in this regard.

It is known in the electrodeposition of nickel or nickel-cobalt (i.e. a nickel-containing coating) to control the finish so as to obtain a uniform semigloss layer by introducing into the plating bath a foreign inorganic solid of restricted particle size which is incorporated in the coating and appears to provide grains which create a granular appearance or serve an nuclei for the metal crystals. However, the matte effect is frequently destroyed by the roughness of the surface. When inorganic particulates are used, moreover, it is difficult, if not impossible, to create and maintain a homogeneous dispersion and hence the coating is nonuniform.

It has been proposed to avoid this disadvantage by introducing into the electrodeposition bath one or more nonionic surfactants. There materials have the disadvantage that they tend to come out of solution with increases in temperature and create an emulsion which is difficult to handle and does not always give good results from the point of view of uniform matte finish.

OBJECTS OF THE INVENTION

It is the principal object of the present invention to provide an improved process for producing semibright nickel-containing coatings upon a metal substrate by nickel plating.

Another object of the invention is to provide an improved electroplating bath which avoids the disadvantages enumerated above.

It is also an object of the invention to provide a method of electroplating nickel or nickel-cobalt layers upon a metal surface which operates with electrolytes having a long useful life, does not require the use of inorganic granulating agents and avoids the disadvantages which have hitherto been encountered with nonionic surfactants with increasing temperatures.

SUMMARY OF THE INVENTION

The invention is based upon our suprising discovery that it is possible to generate an additive to an electroplating bath in situ therein from two well-defined organic components so as to form a flocculate which can be incorporated into the nickel-containing coating but yet does not affect the viscosity and other physical properties of the bath, can be selectively removed, and is free from the other disadvantages of the earlier systems as enumerated above.

The process, according to the invention, for producing a semibright nickel-containing coating upon a metal substrate comprises the steps of electrodepositing the coating from an aqueous electroplating bath and forming in situ within the bath a matte-finish-producing substance by introducing into the bath a cationic or amphoteric first component and a second component yielding organic anions interacting with the first component to produce a flocculate incorporated into the coating.

More generally, the invention is a process for producing semibright or matte-gloss nickel coatings or nickel-cobalt coatings on metal surfaces whereby the metal surface is brought into contact with a nickel electrolyte or a nickel-cobalt electrolyte containing a foreign substance (matting substance) which is incorporated into the coating as the latter is generated. The matting substance is formed within the bath by bringing together a cation-active (cationic) or amphoteric component and organic anions so that the precipitate (flocculate) is cathodically deposited with the coating upon the metal surface. For nickel plating, the usual Watt's electroylte may be used, such an electrolyte consisting of 200 to 450 g/liter of nickel sulfate in the form of one of its hydrates, 40 to 65 g/liter of nickel chloride in the form of one of its hydrates and 30 to 50 g/liter of boric acid. Preferably the Watt's electrolyte consists of about 4300 g/liter of nickel sulfate heptahydrate, -50 g/liter of nickel chloride hexahydrate and 40 g/liter of boric acid. The electrolyte may contain other nickel, cobalt and chloride compounds and, or course, where nickel-cobalt is plated, an equivalent proportion of cobalt salt (chloride or sulfate) may be used. Of course, the bath may also be the usual sulfamate or fluoroborate baths as described in the above-identified publication.

By changing the amount of the foreign substance it is possible to vary the matting effect or the surface granulating appearance.

All cationic or amphoteric substances and all organic anions which, when brought together in the electroplating bath, produce a flocculate, can be used in accordance with the present invention.

Especially good results are obtained when the first component is selected from the group which consists of:

a. quaternary amine compounds of the formula

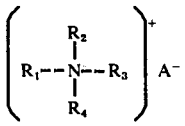

where $R_1$, $R_2$, and $R_3$ and $R_4$ groups are each alkyl, aralkyl of aryl, at least one of these groups includes a long-chain alkyl having 7 to 20 carbon atoms, the alkyls otherwise have 1 to 6 carbon atoms, two of the alkyls can be included in a heterocyclic ring with oxygen, nitrogen or sulfur as the heterocyclic atoms, the alkyl groups are unsubstituted or include ether, carboxylamide or carboxylic acid groups, and $A^-$ is an inorganic anion such as chloride or sulfate. In the latter case, two quaternary amine groups may be associated with each anion or $A^-$ can represent a single valence of the particular anion.

b. Imidazoline compounds.

c. Alkanolamine esters in which the alkyl group has 1 to 18 carbon atoms.

d. Tenside surfactants based upon amino carbonic acids.

The second component may be any compound which produces the aforementioned organic anion by splitting of a proton $H^+$ at the pH at which the electroplating is carried out, i.e. in pH in the range of 2.5 to 5.8. Especially advantageous results are obtained when the organic anion is derived from a compound selected from the group which consists of:

a. surface active alkyl, aryl and alkyl-aryl sulfates, sulfonates and phosphates, the alkyl group containing from 1 to 20 carbon atoms;

b. aliphatic, alicyclic, aromatic (substituted or unsubstituted) sulfates, sulfenic acids or carboxylic acids;

c. sulfonamides and cyclic or noncyclic sulfonimides.

The sole criteria for the organic anion are:

a. that it be present in ionic form at the operating pH;

b. that it be capable of forming a flocculate with the first component in the electroplating bath; and c. that it be free from the undesirable characteristics of the nonionic surfactants hitherto employed and sensitive to elevated temperatures.

Thus while the second component may have surface activity, it is not essential that it be a surfactant.

According to the invention, a so-called primary brightener (for example sulfonamides, sulfonimides or sulfonates) may be supplied. Such brighteners tend to ensure the formation of hard and scratch-free deposits. To influence the optical and texture characteristics, so-called secondary brighteners may be added, especially unsaturated, aliphatic alcohols, unsaturated sulfonates, unsaturated amines and pyridine-ring compounds. The concentrations of the second brightener may be varied to control the reflectivity of the surface of the deposit and the matte effect. Both the primary and secondary brighteners require no further detailed description since both groups are well-known from the literature.

An important advantage of the present system is that in situ formation of the flocculate allows the electrolyte or bath to be used for longer periods than with anionic surfactants and provides a deposit which is more uniform than those which can be obtained with inorganic solid additives. Furthermore, the flocculate can be removed from the bath by adding thereto a filter aid such as asbestos, silica or activated carbon, and filtering the bath. Without such a filter aid, the particulates formed in situ pass through the commercial plate filters and paper filters, at least in part, where such filters are used in the electroplating field. It is thus possible to clean the bath when necessary and to permit selective filtration where other particulates must be removed and it is desired that the particulates formed remain in the bath. The matting effect can be controlled within wide ranges by varying the concentrations of the two components. Of significant advantage is the fact that the semibright effect can be obtained within a broad current-density range of 0.5 to 20 amperes per square decimeter ($A/dm^2$) and with coatings as thin as two microns. The pH may range from 2.5 to 5.8 as previously noted and the electroplating temperature can lie between 15° and 70° C. Preferably the temperature is in the range of 30° to 60° C and the pH between 3.5 and 4.5. Best results are obtained with a current density between 3 and 10 $A/dm^2$.

While applicants have not been fully able to explain the surprising effect of the in situ formation of particulates as previously described in providing, for the first time, satisfactory semibright coatings of nickel and nickel-cobalt it is believed that the two components collectively form a substance which affects the electrocrystallization at the cathode so that granulation occurs in even the thinnest layer, but without detrimentally altering the adherence of the deposit.

SPECIFIC EXAMPLES

EXAMPLE I

| | |
|---|---|
| Bath Composition | |
| Basic Ingredients | |
| 310 g/l | $NiSO_4 \cdot 7 H_2O$ |
| 50 g/l | $NiCl_2 \cdot 6 H_2O$ |
| 40 g/l | $H_3BO_3$ |
| Additive Components: | |
| 2 g/l | saccharin |
| 80 mg/l | cetyltrimethylammoniumchloride |
| Conditions: pH Value 4.0 | Temperature: 55° C |
| Current Density: 5 $A/dm^2$ | |

This bath provides a uniform clear grippable granular-bright nickel deposit.

Instead of saccharin as the source of the organic anion, 2-ethylhexylsulfate can be used in combination with 2-butenediol- (1,4), as brightener. The granular effect is however weaker.

EXAMPLE II

| | |
|---|---|
| Bath Composition | |
| Basic Ingredients as Example I | |
| + 240 mg/l | 2-butenediol-(1,4) |
| 400 mg/l | 2-ethylhexylsulfate |
| 100 mg/l | coconut-oil-trimethylammoniumchloride |
| Conditions: pH Value 4.0 | Temperature 55° C |
| Current Density 5 $A/dm^2$ | |

This bath gives a clear slightly bright granular nickel coating.

Instead of 2-ethylhexylsulfate the following organic anions can be used:

a. laurylethyoxyethersulfate (2 ethoxy groups per molecule)

b. saccharin alone or in combination with 2-propene sulfonic acid

The granular brightness ranges between slightly bright and mat.

EXAMPLE III

Basic Ingredients as Example I
+ 4 g/l saccharin
60 mg/l imidazoline derivatives (Amine C of the firm of Geigy).
Conditions: pH Value 4.0 Temperature 55° C EXAMPLE III-continued

| |
|---|
| Current Density: 5 A/dm² |

This nickel bath provides uniform mat granular nickel coating.

Instead of saccharin, 2-ethylhexylsulfate together with the brightener 2-butenediol- (1,4) can be used. The nickel deposits are then much brighter.

EXAMPLE IV

| | |
|---|---|
| Basic Ingredients as Example I | |
| + 240 mg/l | 2-butenediol-(1,4) |
| 20 mg/l | laurylethersulfate-(2 EtO) |
| 20 mg/l | oleic acid ester of triethylanolamine |
| Conditions: pH value 4.0 | Temperature 55° C |
| Current Density 5 A/dm² | |

This bath gives a uniform slightly bright granular nickel coating.

Instead of laurylethersulfate (2 EtO) saccharin as well as 2-ethylhexylsulfate can be used.

EXAMPLE V

| | |
|---|---|
| Basic Ingredients as Example I | |
| + 4 g/l | saccharin |
| 0.4 g/l | N-lauryl-N-carboxymethyl-diethylenetriamine |
| Conditions pH value 4.0 | Temperature 55° C |
| Current Density 5 A/dm² | |

This bath gives a uniform slightly bright granular nickel coating.

In some cases combinations of different organic anions may be necessary in order to increase the granular brightening effect (see Example II*b*).

In other tests nickel chloride was varied from 5 to 50 g/l. This creates a slight influence on the grain size of the nickel coating. Nickel-cobalt coatings are obtained in a similar manner by replacing half of each nickel salt in each Example by the equivalent quantity of the corresponding cobalt salt.

We claim:

1. A process for producing a semibright nickel-containing coating upon a metal surface comprising the steps of:

electrodepositing said coating upon a substrate from an aqueous electroplating bath; and forming in situ within said bath a mat-finish-producing substance by introducing into said bath an effective amount of a cationic or amphoteric surface-active first component and a second component yielding organic anions interacting with said first component to produce a flocculate incorporated into said coating during the electrodeposition thereof, said first component being selected from the group which consists of:

cetyltrimethyl ammonium chloride,
coconut oil trimethylammonium chloride,
triethanolamine oleic acid ester, and
N-lauryl-N''carboxymethyl-diethylenetriamine;

said second component being selected from the group which consists of:

saccharin,
2-ethylhexyl sulfate,
lauryl-ethylene oxide-ether sulfate,
2-propene sulfonic acid;

said bath containing substantially:

200 to 450 g/liter nickel sulfate,
40 to 65 g/liter nickel chloride, and
30 to 50 g/liter boric acid and the pH is about 4, the temperature is about 55° C and the current density is about 5 A/dm².

2. The process defined in claim 1 wherein said first component is cetyltrimethylammoniumchloride.

3. The process defined in claim 1 wherein said second component is saccharin.

4. The process defined in claim 1, further comprising the step of adding to said bath an effective amount of at least one brightener selected from the group which consists of unsaturated aliphatic alcohols, unsaturated sulfonates, unsaturated amines and compounds containing the pyridine ring.

5. The process defined in claim 4 wherein said brightener is 2-butenediol-(1,4).

6. In a bath for electroplating nickel or nickel-cobalt upon a metal substrate, the improvement which comprises an effective amount of a first component and a second component in said bath reactive to form a flocculate incorporated in the coating upon electrodeposition thereof, said first component being selected from the group which consists of:

cetyltrimethyl ammonium chloride,
coconut oil trimethyl ammonium chloride,
triethanolamine oleic acid ester, and
N-lauryl-N''carboxymethyl-diethylenetriamine; said second component being selected from the group which consists of:

saccharin,
2-ethylhexyl sulfate,
lauryl-ethylene oxide-ether sulfate, and
2-propeneslfonic acid.

7. The improvement defined in claim 6, further comprising in the bath an effective amount of at least one brightener selected from the group which consists of unsaturated aliphatic alcohols, unsaturated sulfonates, unsaturated amines and compounds containing the pyridine ring.

8. The improvement defined in claim 7 wherein said brightener is 2-butenediol-(1,4).

9. The improvement defined in claim 8 wherein said bath contains substantially:

200 to 450 g/liter nickel sulfate,
40 to 64 g/liter nickel chloride, and
30 to 50 g/liter boric acid.

* * * * *